US011043317B2

(12) United States Patent
Shu et al.

(10) Patent No.: US 11,043,317 B2
(45) Date of Patent: Jun. 22, 2021

(54) CONBINED TUBULAR METAL OXIDE VARISTOR AND GAS DISCHARGE TUBE

(71) Applicant: Dongguan Littelfuse Electronics Co., Ltd., Dongguan (CN)

(72) Inventors: Xia Shu, Dongguan (CN); Hailang Tang, Dongguan (CN); Yanjing Xiao, Dongguan (CN)

(73) Assignee: Dongguan Littelfuse Electronics Company Limited, Dougguan (CN)

( * ) Notice: Subject to any disclaimer, the term of this patent is extended or adjusted under 35 U.S.C. 154(b) by 0 days.

(21) Appl. No.: 16/964,285

(22) PCT Filed: Jan. 23, 2018

(86) PCT No.: PCT/CN2018/073735
§ 371 (c)(1),
(2) Date: Jul. 23, 2020

(87) PCT Pub. No.: WO2019/144257
PCT Pub. Date: Aug. 1, 2019

(65) Prior Publication Data

US 2021/0035715 A1 Feb. 4, 2021

(51) Int. Cl.
*H01C 7/12* (2006.01)
*H01C 1/024* (2006.01)
(Continued)

(52) U.S. Cl.
CPC ..... *H01C 7/12* (2013.01); *H01C 1/024* (2013.01); *H01C 1/14* (2013.01); *H01J 17/34* (2013.01)

(58) Field of Classification Search
CPC ..... H01C 7/12; H01C 7/105; H01C 7/108; H01C 1/14; H01C 1/024
See application file for complete search history.

(56) References Cited

U.S. PATENT DOCUMENTS 3,987,343 A * 10/1976 Cunningham ..... H01T 4/06 361/118
4,104,693 A * 8/1978 Toda ..... H01T 1/22 313/346 R
(Continued)

FOREIGN PATENT DOCUMENTS

CN 103400675 A 11/2013
CN 205724371 U 11/2016
WO 2014063362 A1 5/2014

OTHER PUBLICATIONS

International Search Report and Written Opinion dated Oct. 24, 2018 for PCT/CN2018/073735.

*Primary Examiner* — Kyung S Lee
(74) *Attorney, Agent, or Firm* — Kacvinsky Daisak Bluni PLLC

(57) ABSTRACT

Provided herein are protection devices having a tubular ceramic part and a tubular metal oxide varistor (MOV) electrically coupled in series or parallel. In some embodiments, the tubular ceramic part is connected between a first electrode and a second electrode, and the tubular MOV is connected between the second electrode and a third electrode. In some embodiments, the tubular ceramic part and the tubular MOV have a same or similar shape and/or outer circumference. The protection device further includes an enclosure surrounding the tubular ceramic part and the tubular MOV, wherein the first electrode, the second electrode, and the third electrode each have leads extending outside the enclosure. In some embodiments, the tubular MOV includes a central cavity aligned with a central cavity of the tubular ceramic part, wherein the central cavity of the tubular MOV MOV and the central cavity of the tubular ceramic part contain an inert gas.

20 Claims, 4 Drawing Sheets

(51) Int. Cl.
*H01C 1/14* (2006.01)
*H01J 17/34* (2006.01)

(56) References Cited

U.S. PATENT DOCUMENTS

| | | | | |
|---|---|---|---|---|
| 4,527,215 | A | 7/1985 | Wessing | |
| 5,982,597 | A * | 11/1999 | Webb | H01C 7/108 361/103 |
| 6,211,770 | B1 * | 4/2001 | Coyle | H01C 7/126 338/101 |
| 7,612,648 | B2 * | 11/2009 | Jeong | H01C 7/123 174/526 |
| 2004/0100747 | A1 * | 5/2004 | Vo | H01C 7/108 361/78 |
| 2014/0092514 | A1 * | 4/2014 | Chen | H01C 7/12 361/118 |
| 2017/0221613 | A1 | 8/2017 | Yang et al. | |

* cited by examiner

CONBINED TUBULAR METAL OXIDE VARISTOR AND GAS DISCHARGE TUBE

FIELD OF THE DISCLOSURE

The disclosure relates generally to the protection of electrical and electronic circuits and equipment from power surges and, more particularly, to a combined tubular metal oxide varistor and gas discharge tube.

BACKGROUND OF THE DISCLOSURE

A variety of devices are available on the market that are designed to protect devices that are susceptible to damage by voltage surge when the voltage applied between power terminals exceeds a maximum acceptable threshold. For example, some prior art approaches include metal oxide varistors (MOVs), based on semiconductors and the like, as well as gas discharge tube (GDT) devices. MOV devices are generally fast acting, which is very desirable in certain applications, but with the inconvenience of not being able to absorb an unlimited number of surges. That is, MOVs degrade with use and in the end fail. The number of times an MOV device shall function correctly depends on the energy absorbed each time it functions. Furthermore, there is the inconvenience that the MOV device may short circuit in case of malfunction, necessitating some other type of protection against this inconvenience.

With regard to GDT devices, which are generally slower acting devices that function by producing an electric arc in their interior when nominal voltage is surpassed, impedance between their terminals during use diminishes drastically, potentially causing a short circuit. Furthermore, GDT devices have relatively small capacitance.

One prior art solution uses separate GDT and MOV devices connected in series between the terminals of the element to be protected. This combination has the advantage that taken together, capacitance is approximately equal to that of the GDT device (a few pF). Generally, if the MOV device and the GDT device are similar in size, then protection capability depends on the MOV device because capacitance of the GDT device is higher. When the MOV device and the GDT device act in a protection stage, the combined resistance is reduced significantly. However, this solution has significant size constraints, which limit use in space saving condition.

Thus, there presently exists a need for a combined MOV and GDT that overcomes the deficiencies of the prior art.

SUMMARY OF THE DISCLOSURE

In one approach according to the present disclosure, a protection device, may include a tubular ceramic part having a first end coupled to a first electrode and a second end coupled to a second electrode, and a tubular metal oxide varistor (MOV) having a first end coupled to the second electrode and a second end coupled to a third electrode. The tubular MOV may include a central cavity aligned with a central cavity of the tubular ceramic part, the central cavity of the tubular MOV and the central cavity of the tubular ceramic part containing an inert gas. The protection device may further include an enclosure surrounding the tubular ceramic part and the tubular MOV.

In another approach according to the present disclosure, a protection module, may include a tubular ceramic part having a first end directly coupled to a first electrode and a second end directly coupled to a second electrode, and a tubular metal oxide varistor (MOV) having a first end directly coupled to the second electrode and a second end directly coupled to a third electrode, wherein the tubular MOV includes a central cavity aligned with a central cavity of the tubular ceramic part, and wherein the central cavity of the tubular MOV and the central cavity of the tubular ceramic part contains an inert gas. The protection module may further include an enclosure surrounding the tubular ceramic part and the tubular MOV within a same internal cavity.

In another approach according to the present disclosure, a protection device includes a tubular ceramic part having a first end directly coupled to a first electrode and a second end directly coupled to a second electrode, and a tubular metal oxide varistor (MOV) having a first end directly coupled to the second electrode and a second end directly coupled to a third electrode, wherein a central cavity of the tubular ceramic part is fluidly connected with a central cavity of the tubular MOV, and wherein an inert gas is disposed within the central cavity of the tubular MOV and the central cavity of the tubular ceramic part. The protection device may further include an enclosure surrounding the tubular ceramic part and the tubular MOV.

BRIEF DESCRIPTION OF THE DRAWINGS

The accompanying drawings illustrate exemplary approaches of the disclosed embodiments so far devised for the practical application of the principles thereof, and in which.

Figure 1:
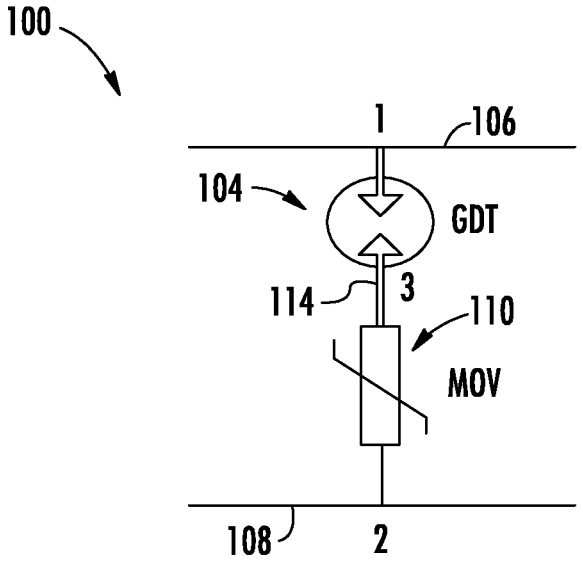
FIG. 1 depicts a circuit diagram of a GDT electrically connected with a tubular MOV according to embodiments of the present disclosure.
Figure 2:
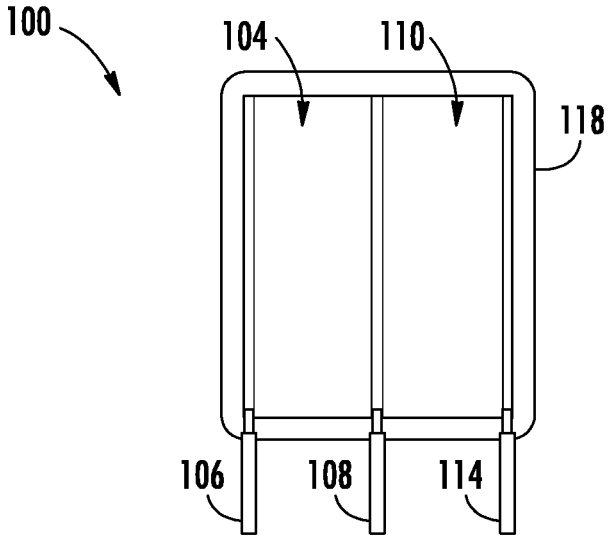
FIG. 2 depicts a side view of a protection device including a protection device including a tubular ceramic part coupled with a tubular MOV according to embodiments of the present disclosure.
Figure 3:
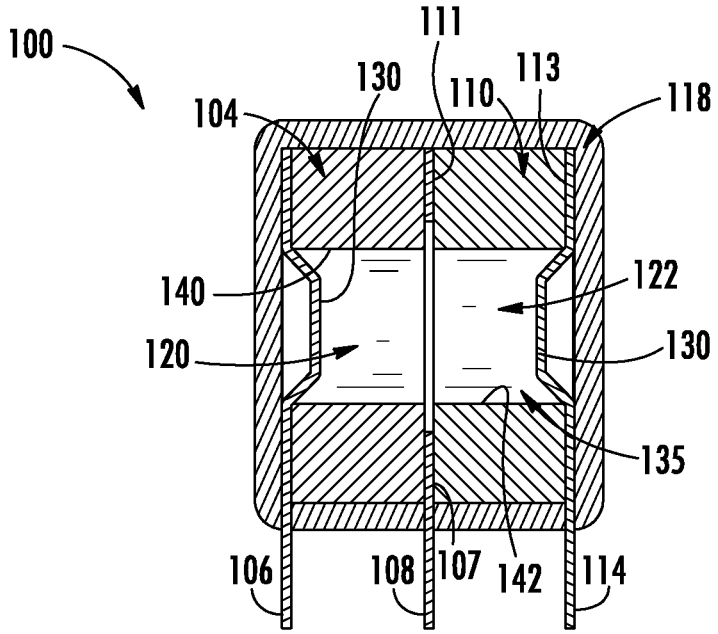
FIG. 3 depicts a side cross-sectional view of the protection device of FIG. 2 according to embodiments of the present disclosure.

The drawings are not necessarily to scale. The drawings are merely representations, not intended to portray specific parameters of the disclosure. The drawings are intended to depict typical embodiments of the disclosure, and therefore should not be considered as limiting in scope. In the drawings, like numbering represents like elements.

Furthermore, certain elements in some of the figures may be omitted, or illustrated not-to-scale, for illustrative clarity.

Still furthermore, for clarity, some reference numbers may be omitted in certain drawings.

DETAILED DESCRIPTION

Embodiments in accordance with the present disclosure will now be described more fully hereinafter with reference to the accompanying drawings. The device/circuit may be embodied in many different forms and should not be construed as being limited to the embodiments set forth herein. Rather, these embodiments are provided so that this disclosure will be thorough and complete, and will fully convey the scope of the system and method to those skilled in the art.

For the sake of convenience and clarity, terms such as "top," "bottom," "upper," "lower," "vertical," "horizontal," "lateral," and "longitudinal" will be used herein to describe the relative placement and orientation of various components and their constituent parts. Said terminology will include the words specifically mentioned, derivatives thereof, and words of similar import.

As used herein, an element or operation recited in the singular and proceeded with the word "a" or "an" should be understood as not excluding plural elements or operations, unless such exclusion is explicitly recited. Furthermore, references to "one embodiment" of the present disclosure are not intended to be interpreted as excluding the existence of additional embodiments that also incorporate the recited features.

Furthermore, in the following description and/or claims, the terms "on", "overlying," "disposed on" and "over" may be used in the following description and claims. "On," "overlying," "disposed on" and "over" may be used to indicate that two or more elements are in direct physical contact with each other. However, "on,", "overlying," "disposed on," and over, may also mean that two or more elements are not in direct contact with each other. For example, "over" may mean that one element is above another element but not contact each other and may have another element or elements in between the two elements. Furthermore, the term "and/or" may mean "and", it may mean "or", it may mean "exclusive-or", it may mean "one", it may mean "some, but not all", it may mean "neither", and/or it may mean "both", although the scope of claimed subject matter is not limited in this respect.

As will be described herein, embodiments of the present disclosure address the GDT follow-on current issue of the prior art by providing a tubular MOV in series with a tubular ceramic part, which can advantageously cut off the follow-on current because the tubular MOV will resume a high resistance state immediately when voltage is reduced to normal levels as a surge subsides. Furthermore, embodiments of the present disclosure address the MOV degradation issues of the prior art, as there is no voltage applied on the tubular MOV in a normal state, thus allowing the life of the tubular MOV to be significantly longer. Still furthermore, embodiments of the present disclosure address the deficiencies of the prior art by alternatively providing the tubular MOV and GDT in parallel, which provides most of the current to flow through the tubular GDT during a surge event. In some embodiments, because the tubular MOV reacts faster than the tubular GDT, present embodiments advantageously provide an inductor to coordinate the reaction of the tubular GDT and MOV.

To accomplish the above advantages, provided herein are protection devices having a tubular ceramic part and a tubular MOV electrically coupled in a series or parallel arrangement. In some series connection-type embodiments, the protection device includes a ceramic part (e.g., $Al^2O^3$) connected between a first electrode and a second electrode, and a ceramic MOV (e.g., ZnO) connected between the second electrode and a third electrode. The protection device further includes an enclosure surrounding the tubular ceramic part and the tubular MOV, wherein leads of the first electrode, the second electrode, and the third electrode extend outside the enclosure. In some parallel connection-type embodiments, the tubular ceramic part includes a tubular inductor positioned between the tubular ceramic part and the tubular MOV, which are electrically connected in parallel. In some embodiments, the protection device includes an inductor, wherein the inductor is electrically connected to the first electrode and the second electrode.

In some embodiments of the present disclosure, the protection device is a surge protector including the tubular MOV and the tubular ceramic part along with a resistor. The inert gas of the tubular ceramic part may be non-conductive below a trigger voltage, and conductive above the trigger voltage. The tubular MOV and the tubular ceramic part may be connected in parallel with each other, and the resistor may be connected in series with the tubular MOV and the tubular ceramic part.

The protection device of the present disclosure may provide protection for any electrical component such as an electrical device, an electrical machine, or electrical equipment. In some embodiments, the component to be protected is a motor drive for an electric machine. In embodiments, the electric machine is a direct-current (DC) or alternating-current (AC), fractional horsepower (HP) electric machine. The electric machine may be powered by a voltage signal (AC or DC), and generates power under 1 HP.

Turning now to FIGS. 1-4, a protection module or device 100 according to embodiments of the present disclosure will be described in greater detail. As shown, the protection device 100 may include a cylindrical or tubular shaped ceramic part 104 connected between a first electrode 106 and a second electrode 108, and a cylindrical or tubular shaped metal oxide varistor (MOV) 110 connected between the second electrode 108 and a third electrode 114. The tubular ceramic part 104 and the tubular MOV 110 may be electrically connected in series. In some embodiments, the tubular ceramic part 104 and the tubular MOV 110 are coupled together on opposite sides of the second electrode 108. More specifically, the tubular ceramic part 104 may include a first end 105 opposite a second end 107, wherein the first end 105 is directly physically and electrically coupled to the first electrode 106, and the second end 107 is directly physically and electrically coupled to the second electrode 108. The tubular MOV 110 may also include a first end 111 opposite a second end 113, wherein the first end 111 is directly physically and electrically coupled to the second electrode 108 and the second end 113 is directly and physically coupled to the third electrode 114.

Figure 4:
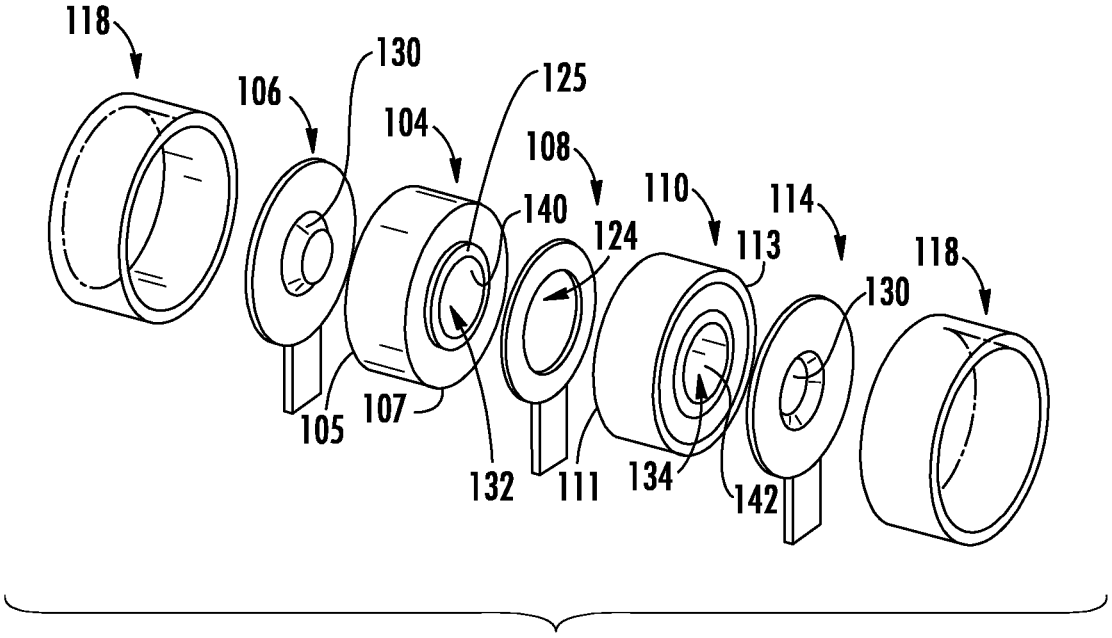
FIG. 4 depicts an exploded view of the protection device of FIG. 2 according to embodiments of the present disclosure.
Figure 5:
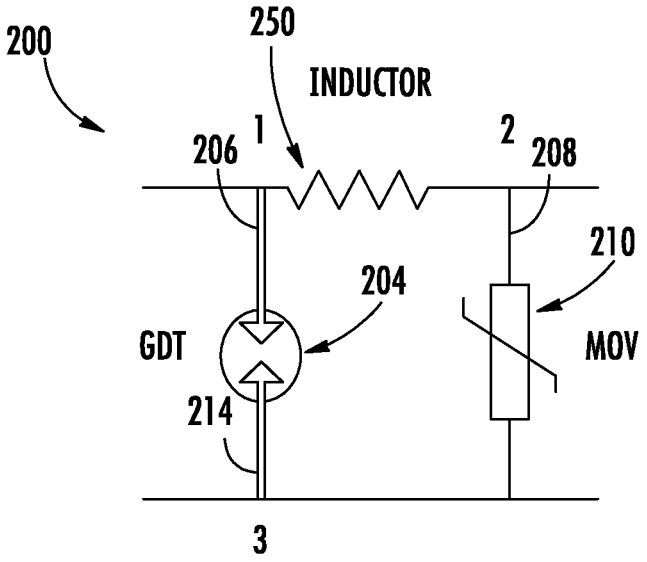
FIG. 5 depicts a circuit diagram of a GDT electrically connected with a tubular MOV according to embodiments of the present disclosure.
Figure 6:
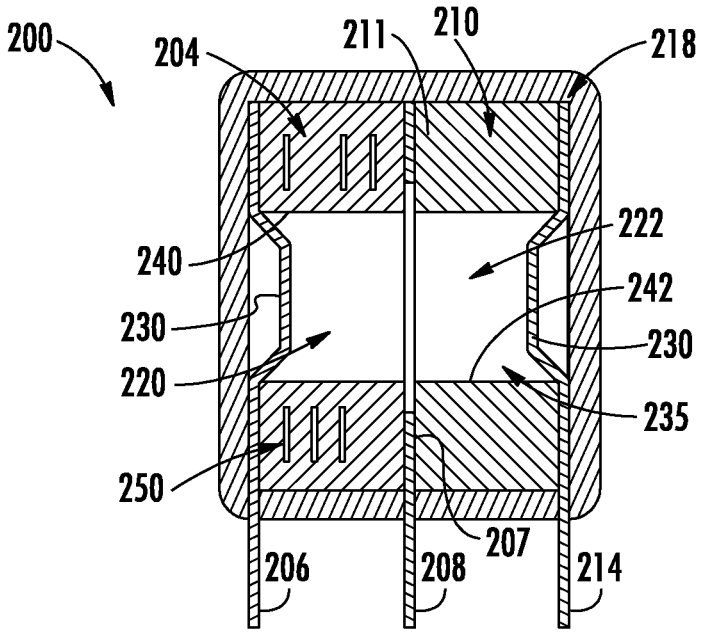
FIG. 6 depicts a side cross-sectional view of a protection device including a protection device including a tubular inductor coupled with a tubular MOV according to embodiments of the present disclosure.
Figure 7:
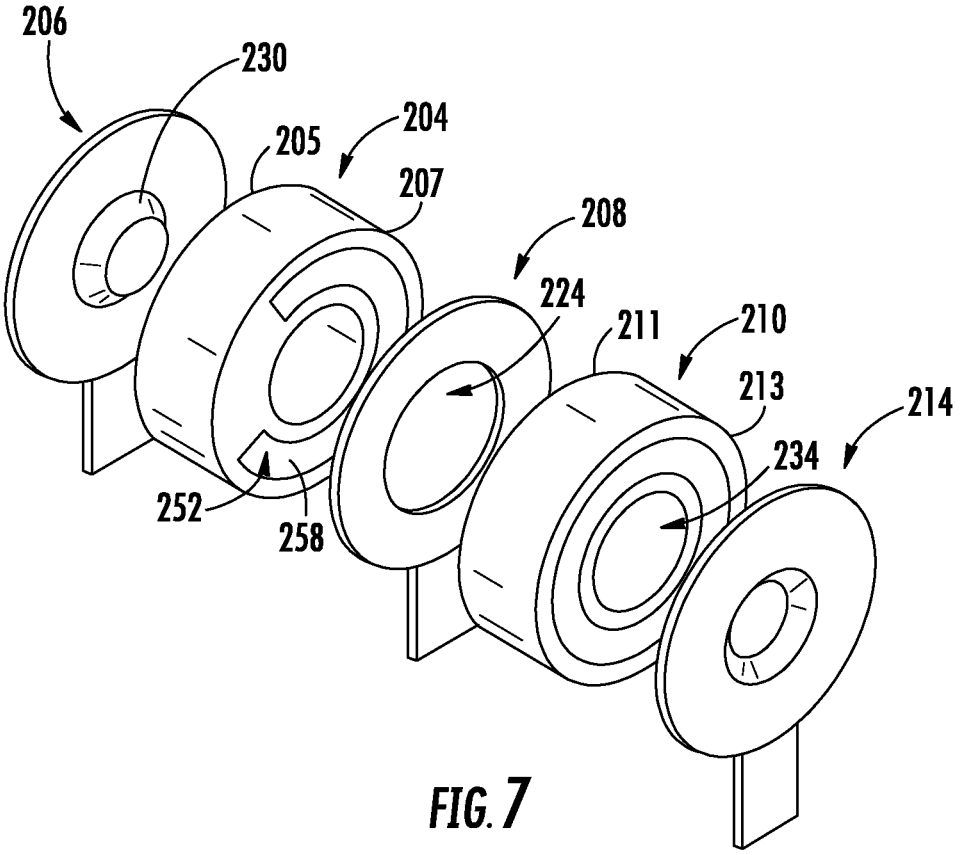
FIG. 7 depicts an exploded view of a portion of the protection device of FIG. 6 according to embodiments of the present disclosure.
Figure 8A:
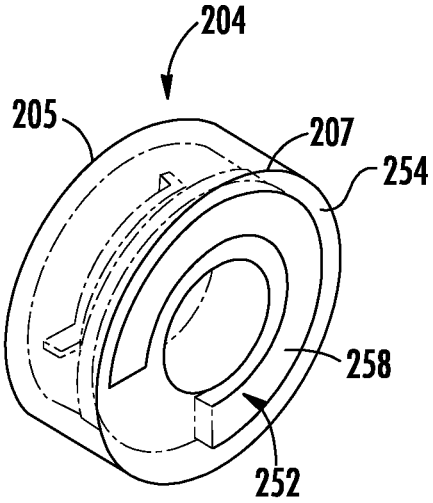
FIGS. 8A-8B depict perspective views of an inductor of the protection device of FIG. 6 according to embodiments of the present disclosure.
Figure 8B:
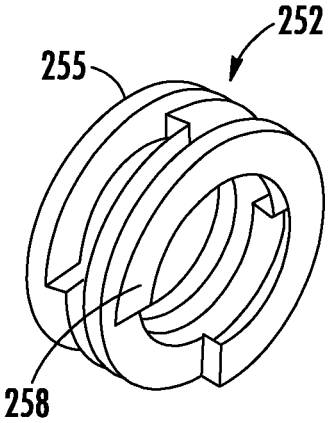

An enclosure 118, such as a coating, encapsulation layer and/or a housing, may be formed over the tubular ceramic part 104 and the tubular MOV 110, wherein leads of the first electrode 106, the second electrode 108, and the third electrode 114 extend outside of the enclosure 118. In some embodiments, the enclosure 118 may include first and second halves, for example as depicted in FIG. 4. As shown, the tubular ceramic part 104 and the tubular MOV 110 may have a same, or substantially the same, shape and outer circumference to permit the combined elements to be efficiently retained within the enclosure 118. Furthermore, the first electrode 106, the second electrode 108, and the third electrode 114 may all have a same, or substantially the same, outer circumference, which may also be the same or similar to the that of the tubular ceramic part 104 and the tubular MOV 110.

The tubular ceramic part 104 and the tubular MOV 110 may be coupled together to form a continuous cavity 120 extending between the tubular ceramic part 104 and the tubular MOV 110. In some embodiments, an inert gas 122 is disposed within the cavity 120. To accommodate flow of the inert gas 122 between the tubular ceramic part 104 and the tubular MOV 110, the second electrode 108 may include a central opening 124. In some embodiments, as best shown in FIG. 4, the tubular ceramic part 104 may include a projection or rim 125 configured to engage an inner circular surface 127 of the second electrode 108 to align the second electrode 108 with the tubular ceramic part 104.

As further shown, each of the first electrode 106 and the third electrode 114 may include a centering projection 130 extending inwardly towards the second electrode 108. For example, the centering projection 130 of the first electrode 106 may extend into a central cavity 132 of the tubular ceramic part 104, while the centering projection 130 of the third electrode 114 may extend into a central cavity 134 of the tubular MOV 110.

In some embodiments, an insulation layer 135 (FIG. 3) may be provided along an interior surface of the cavity 120. More specifically, the insulation layer 135 may be provided along an interior surface 140 of the tubular ceramic part 104 and along an interior surface 142 of the tubular MOV 110 so that current flows from the first lead 106 to the third lead 114 and then to the second lead 108. In exemplary embodiments, the central cavity 132 of the tubular ceramic part 104 is fluidly connected with the central cavity 134 of the tubular MOV 110, thus permitting the inert gas 122 to fill both central cavities 132 and 134.

During use, the tubular MOV 110 is designed to limit surge voltages by clamping the voltage. For example, the tubular MOV 110 may provide a variable resistance that is based on the voltage across the tubular MOV 110. The tubular MOV 110 includes a corresponding voltage threshold or break-over voltage. Exemplary break-over voltages (Vn) for the tubular MOV 110 may be between approximately 200V and 800V. When voltage across the tubular MOV 110 is less than its break-over voltage, the tubular MOV 110 has a high resistance that limits current flow. When the voltage across the tubular MOV 110 is above its break-over voltage, the tubular MOV 110 has a relatively low resistance that limits the voltage.

The tubular ceramic part 104 also limits voltage. The tubular ceramic part 104 may include an inert gas within a ceramic housing that is capped by the first electrode 106 and the second electrode 108. The tubular ceramic part 104 may have a trigger voltage, above which the tubular ceramic part 104 becomes conductive. An exemplary trigger voltage may be between 3000V and 3500V, for example. In other embodiments, the trigger voltage may be between 200V and 800V. When the voltage across the tubular ceramic part 104 is below the trigger voltage, the tubular ceramic part 104 is non-conductive (i.e., no current flow therethrough). When the voltage across the tubular ceramic part 104 is above the trigger voltage, the tubular ceramic part 104 is conductive and current flows therethrough. Once the tubular ceramic part 104 is triggered, it becomes highly conductive. This further limits the voltage and reduces the possibility of damage from the voltage surge. The tubular ceramic part 104 may form or comprise a spark gap, and a resistor may be placed across this spark gap.

Turning now to FIGS. 5-8B, a protection module or device 200 according to embodiments of the present disclosure will be described in greater detail. As shown, the protection device 200 may include a tubular ceramic part 204, which in this embodiment may be a tubular inductor. The tubular inductor 204 may be connected between a first electrode 206 and a second electrode 208, and a tubular MOV 210 is connected between the second electrode 208 and a third electrode 214. The tubular inductor 204 and the tubular MOV 210 are electrically connected in parallel. As shown, the protection device 200 may include an inductor 250 connected in series with the tubular inductor 204 and the tubular MOV 210. In some embodiments, the tubular inductor 204 and the tubular MOV 210 are coupled together on opposite sides of the second electrode 208. More specifically, the tubular inductor 204 may include a first end 205 opposite a second end 207, wherein the first end 205 is directly physically and electrically coupled to the first electrode 206, and the second end 207 is directly physically and electrically coupled to the second electrode 208. The tubular MOV 210 may also include a first end 211 opposite a second end 213, wherein the first end 211 is directly physically and electrically coupled to the second electrode 208 and the second end 213 is directly and physically coupled to the third electrode 214.

An enclosure 218 (FIG. 6), such as a coating, encapsulation layer and/or a housing, may be formed over the tubular inductor 204 and the tubular MOV 210, wherein leads of the first electrode 206, the second electrode 208, and the third electrode 214 extend outside of the enclosure 218. As shown, the tubular inductor 204, the tubular MOV 210, the first electrode 206, the second electrode 208, and the third electrode 214 may all have a same, or substantially the same, outer circumference to permit the internal elements of the protection device 200 to be efficiently retained by the enclosure 218.

The tubular inductor 204 may be a cylindrical ceramic component, wherein a cavity 220 extends between the tubular inductor 204 and the tubular MOV 210. In some embodiments, an inert gas 222 is disposed within the cavity 220. To accommodate flow of the inert gas 222 between the tubular inductor 204 and the tubular MOV 210, the second electrode 208 may include a central opening 224. As further shown, each of the first electrode 206 and the third electrode 214 may include a centering projection 230 extending inwardly towards the second electrode 208. For example, the centering projection 230 of the first electrode 206 may extend into a central cavity 232 of the tubular inductor 204, while the centering projection 230 of the third electrode 214 may extend into a central cavity 234 of the tubular MOV 210. In some embodiments, an insulation layer 235 (FIG. 6) may be provided along an interior surface of the cavity 220. More specifically, the insulation layer 235 may be provided along an interior surface 240 of the tubular inductor 204 and along an interior surface 242 of the tubular MOV 210. In exemplary embodiments, the central cavity 232 of the tubular inductor 204 is fluidly connected with the central cavity 234 of the tubular MOV 210.

In this embodiment, the protection device 200 may include the inductor 250 disposed between the tubular inductor 204 and the tubular MOV 210. As shown, the inductor 250 may be a tubular inductor including a spiral coil 252 surrounded by a ceramic (e.g., $Al_2O_3$) tube insulation 254. The spiral coil 252 has a first end 255 electrically connected to the first electrode 206 and a second end 258 electrically connected to the second electrode 208. As shown, the spiral coil 252 may be substantially surrounded by the tube insulation 254, while the outer surfaces of the first and second ends 255, 258 remain exposed at the first and second ends 205 and 207, respectively, for connection with adjacent layers. In some embodiments, the tubular inductor 250 may be made by tape-casting and lamination, similar to techniques used for multi-layer varistors.

While the present disclosure has been described with reference to certain approaches, numerous modifications, alterations and changes to the described approaches are possible without departing from the sphere and scope of the present disclosure, as defined in the appended claims. Accordingly, it is intended that the present disclosure not be limited to the described approaches, but that it has the full scope defined by the language of the following claims, and equivalents thereof. While the disclosure has been described with reference to certain approaches, numerous modifications, alterations and changes to the described approaches are possible without departing from the spirit and scope of the disclosure, as defined in the appended claims. Accordingly, it is intended that the present disclosure not be limited to the described approaches, but that it has the full scope defined by the language of the following claims, and equivalents thereof.

The invention claimed is:

1. A protection device, comprising:

a tubular ceramic part having a first end coupled to a first electrode and a second end coupled to a second electrode;

a tubular metal oxide varistor (MOV) having a first end coupled to the second electrode and a second end coupled to a third electrode, wherein the tubular MOV includes a central cavity aligned with a central cavity of the tubular ceramic part, the central cavity of the tubular MOV and the central cavity of the tubular ceramic part containing an inert gas; and an enclosure surrounding the tubular ceramic part and the tubular MOV.

2. The protection device according to claim 1, wherein the first electrode, the second electrode, and the third electrode each include leads extending outside the enclosure.

3. The protection device according to claim 1, wherein the tubular ceramic part and the tubular MOV are electrically connected in parallel or electrically connected in series by the inert gas.

4. The protection device according to claim 3, wherein the tubular ceramic part includes a tubular inductor.

5. The protection device according to claim 3, wherein the tubular inductor is positioned between the parallel connected ceramic part and the tubular MOV.

6. The protection device according to claim 3, wherein the tubular inductor comprises a spiral coil connected to the first electrode and the second electrode.

7. The protection device according to claim 1, wherein the central cavity of the tubular MOV is fluidly connected with the central cavity of the tubular ceramic part.

8. The protection device according to claim 7, wherein an insulation layer is disposed along an interior surface of the central cavity of the tubular MOV and the central cavity of the tubular ceramic part.

9. The protection device according to claim 8, wherein the inert gas is non-conductive below a trigger voltage and conductive above the trigger voltage.

10. The protection device according to claim 1, wherein the second electrode includes a central opening, and wherein the first electrode and the second electrode each include a centering projection extending towards the second electrode.

11. A protection module, comprising:

a tubular ceramic part having a first end directly coupled to a first electrode and a second end directly coupled to a second electrode;

a tubular metal oxide varistor (MOV) having a first end directly coupled to the second electrode and a second end directly coupled to a third electrode, wherein the tubular MOV includes a central cavity aligned with a central cavity of the tubular ceramic part, and wherein the central cavity of the tubular MOV and the central cavity of the tubular ceramic part contains an inert gas; and an enclosure surrounding the tubular ceramic part and the tubular MOV within a same internal cavity.

12. The protection module according to claim 11, wherein the first electrode, the second electrode, and the third electrode each include leads extending outside the enclosure.

13. The protection module according to claim 11, wherein the tubular ceramic part and the tubular MOV are one of: electrically connected in parallel by the inert gas, and electrically connected in series by the inert gas.

14. The protection module according to claim 13, wherein the tubular ceramic part includes an inductor.

15. The protection module according to claim 14, wherein the inductor comprises a spiral coil electrically connected to the first electrode and the second electrode.

16. The protection module according to claim 11, further comprising an insulation layer disposed along an interior surface of the central cavity of the tubular MOV and along an interior surface of the central cavity of the tubular ceramic part.

17. The protection module according to claim 11, wherein the second electrode includes a central opening, and wherein the first electrode and the second electrode each include a centering projection extending towards the second electrode.

18. A protection device comprising:

a tubular ceramic part having a first end directly coupled to a first electrode and a second end directly coupled to a second electrode;

a tubular metal oxide varistor (MOV) having a first end directly coupled to the second electrode and a second end directly coupled to a third electrode, wherein a central cavity of the tubular ceramic part is fluidly connected with a central cavity of the tubular MOV, and wherein an inert gas is disposed within the central cavity of the tubular MOV and the central cavity of the tubular ceramic part; and an enclosure surrounding the tubular ceramic part and the tubular MOV.

19. The protection device according to claim 18, wherein an outer circumference of the tubular ceramic part is substantially the same as an outer circumference of the tubular MOV.

20. The protection device according to claim 18, further comprising a spiral coil inductor electrically connected to the first electrode and the second electrode.

* * * * *